US008783923B2

(12) United States Patent
Chang et al.

(10) Patent No.: US 8,783,923 B2
(45) Date of Patent: Jul. 22, 2014

(54) AUTO LAMP STRUCTURE

(75) Inventors: Ming Chang, Chung Li (TW); Wen-Bin Chen, Chung Li (TW); Chi-Tang Hsieh, Chung Li (TW)

(73) Assignee: Chung Yuan Christian University, Chung Li (TW)

( * ) Notice: Subject to any disclaimer, the term of this patent is extended or adjusted under 35 U.S.C. 154(b) by 608 days.

(21) Appl. No.: 12/971,421

(22) Filed: Dec. 17, 2010

(65) Prior Publication Data

US 2011/0228547 A1 Sep. 22, 2011

(30) Foreign Application Priority Data

Mar. 18, 2010 (TW) ..... 99108005 A
Mar. 18, 2010 (TW) ..... 99108015 A

(51) Int. Cl.
*F21S 8/10* (2006.01)

(52) U.S. Cl.
USPC ..... 362/518; 362/507; 362/296.06; 362/538

(58) Field of Classification Search
None
See application file for complete search history.

(56) References Cited

U.S. PATENT DOCUMENTS

| | | | | |
|---|---|---|---|---|
| 1,819,725 | A * | 8/1931 | Wood | 362/296.06 |
| 4,583,528 | A * | 4/1986 | Bauman | 600/199 |
| 7,244,057 | B2 * | 7/2007 | Watanabe et al. | 362/544 |
| 7,281,832 | B2 * | 10/2007 | Ishida et al. | 362/544 |
| 7,513,654 | B2 * | 4/2009 | Okada | 362/297 |
| 7,543,963 | B2 * | 6/2009 | Bernard et al. | 362/297 |

* cited by examiner

*Primary Examiner* — Sharon Payne
(74) *Attorney, Agent, or Firm* — Rosenberg, Klein & Lee

(57) ABSTRACT

The present invention relates to an auto lamp structure, which comprises a reflector, a light source, and a covering part. The reflector exhibits a first ellipse in the direction of a first axis about a center, and exhibits a second ellipse in the direction of a second axis about the center. The long axis or the short axis of the first ellipse is different from the long axis or the short axis of the second ellipse. In addition. the reflector has an opening. The light source is disposed in the reflector, and illuminates light via the opening. The covering part is disposed above the reflector for controlling the distribution pattern of the light. Thereby, the present invention uses a reflector of a complex ellipse structure to control the distribution pattern of the light of the light source for complying with the regulations.

4 Claims, 10 Drawing Sheets

AUTO LAMP STRUCTURE

FIELD OF THE INVENTION

The present invention relates generally to an auto lamp structure, and particularly to an auto lamp structure that can control the distribution pattern of the light of the light source for complying with the regulation, and can enhance the illumination performance of the auto lamp.

BACKGROUND OF THE INVENTION

The major purpose of automobiles is to provide a means of transportation. After the basic purpose of transportation is achieved, its safety becomes the issue to be addressed. Safety can be categorized into active safety and passive safety. Auto lamps are the first line of defense for active safety. They are extremely important for night driving. They mainly provide sufficient illumination for drivers to know the road conditions, and thereby increasing the safety of night driving. Accordingly, people generally make much of auto lamps.

In addition, auto lamps occupy a significant portion of the output value of domestic automobile components. Traditional headlamps are difficult to comply with current international regulations, and hence are gradually replaced by novel ones. Novel headlamp optical systems are developed, such as multi-reflector (MR) headlamps, free-form reflector (FR) headlamps, poly-ellipsoid-system (PES) headlamps, and high intensity discharge (HID) headlamps.

Furthermore, the influence of auto lamps on opposite lanes is respected increasingly in recent years. Owing to the maturity of HID headlamps, more drivers replace their original lamps with HID headlamps without any adjustment and modification. Hence, their lighting pattern does not comply with the regulations, and may affect vehicles in the opposite direction due to scattering or glare. Taking Taiwan for example, from 2007, those cars with HID headlamps that are not installed by the original car manufacturers has to be re-examined for their distribution pattern of light in the Motor Vehicle Supervision Offices. The passed cars will be marked with HID headlamps in their car permit. It is thus clear that in addition to illuminating the roads for drivers, a good design for auto lamps also has to consider the safety and comfort of other people on the roads. According to the traffic division of Taipei, relatively high percentage (19%) of the reasons of traffic accidents in 2008 are due to inattention of conditions in front of the cars. Besides, according to the public security department of China, the traffic accidents in 2005 are mainly occurred between 2 pm to 10 pm, occupying 45.4% of traffic accidents.

It is evident that traffic accidents tend to occur under the conditions of insufficient light around the roads or failing to beware of changes in road conditions. Accordingly, in addition to relying on the original illuminating equipment on roads, the lighting system on cars also plays an important role. Recently, there are many discussions and news regarding to HID headlamps installed on cars and relevant examination regulations. Many of them are related to modifying the lamps without authorization. The modified lamps might have lighting pattern not complying with the regulations, and hence affecting the opposite lanes. Thereby, the present invention adopts the light source of the next-generation, the light-emitting diodes, with novel optical designs for providing auto lamps that can comply with the regulations.

SUMMARY

An objective of the present invention to provide an auto lamp structure, which uses a reflector of a complex ellipse structure to control the distribution pattern pf the light of the light source for complying with the regulations.

Another objective of the present invention to provide an auto lamp structure, which uses a tangent-control lamp module to control the distribution pattern of the light of the light source for avoiding producing sharp or contrasting edge regions.

Still another objective of the present invention to provide an auto lamp structure, which uses a uniform-illumination lamp module to even the distribution pattern of the light of the light source of the auto lamp structure.

A further objective of the present invention to provide an auto lamp structure, which disposes the reflector under the covering part so that the light of the light source is illuminated to the ground via the reflector and the covering part. Thereby, the light source can be reused, and hence reducing relatively light power loss and enhancing efficiency.

The auto lamp structure according to the present invention comprises a reflector, a light source, and a covering part. The reflector exhibits a first ellipse in the direction of a first axis about a center, and exhibits a second ellipse in the direction of a second axis about the center. The long axis or the short axis of the first ellipse is different from the long axis or the short axis of the second ellipse. In addition, the reflector has an opening. The light source is disposed in the reflector, and illuminates light via the opening. The covering part is disposed above the reflector for controlling the distribution pattern of the light. Thereby, the present invention uses a reflector of a complex ellipse structure to control the distribution pattern of the light of the light source for complying with the regulations.

Besides, because the reflector is disposed under the covering part so that the light of the light source is illuminated to the ground via the reflector and the covering part, the light source can be reused, and hence reducing relatively light power loss and enhancing efficiency.

Moreover, the auto lamp structure according to the present invention comprises a reflector, a light source, and a light guide. The reflector has an elliptic surface. The light source is disposed in the reflector fro emitting light. The light guide is disposed in front of the reflector for controlling the distribution pattern of the light. Thereby, the distribution pattern of the light of the auto lamp structure can be uniform.

Furthermore, the auto lamp structure according to the present invention comprises a condensed-illumination lamp module, a tangent-control lamp module, and a uniform-illumination lamp module. The condensed-illumination lamp module is used forproducing first light and hence enhancing the central brightness of a lighting pattern of the auto lamp structure. The tangent-control lamp module is located on one side of the condensed-illumination lamp module, and produces second light for controlling the tangent of the lighting pattern of the auto lamp structure. The uniform-illumination lamp module is disposed on one side of the condensed-illumination lamp module and under the tangent-control lamp module for evening the lighting pattern of the auto lamp structure. Accordingly, by using the tangent-control lamp module to control the distribution pattern of the light of the light source for avoiding producing sharp or contrasting edge regions.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
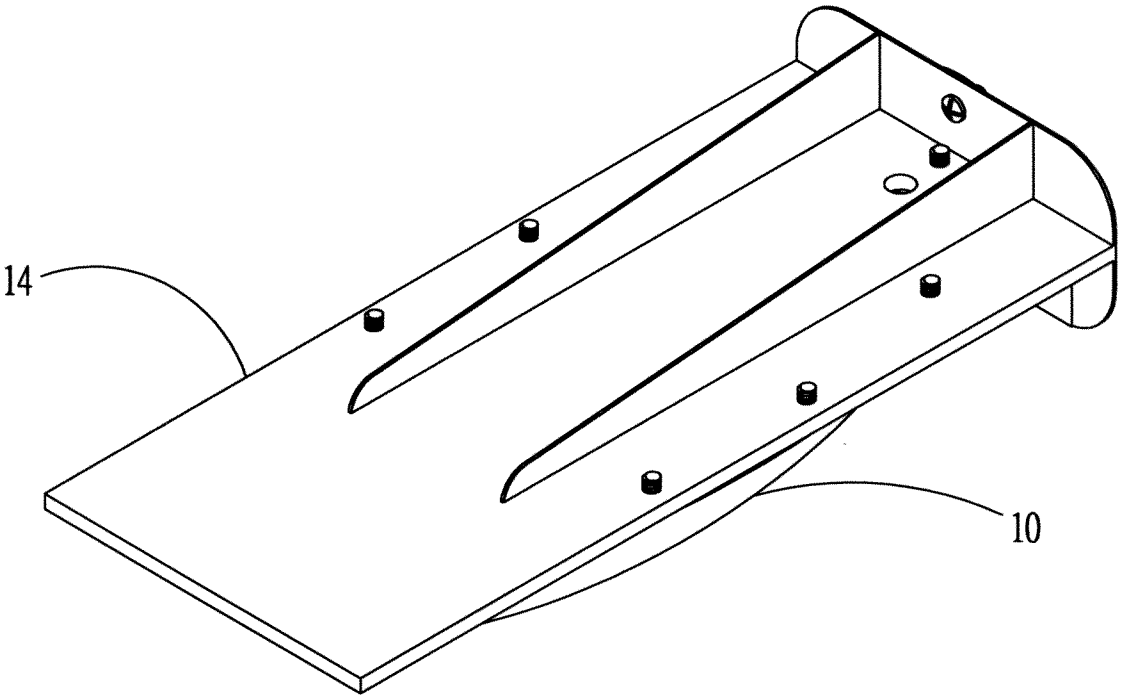
FIG. 1 shows a schematic diagram of an auto lamp structure according to a preferred embodiment of the present invention.
Figure 2:
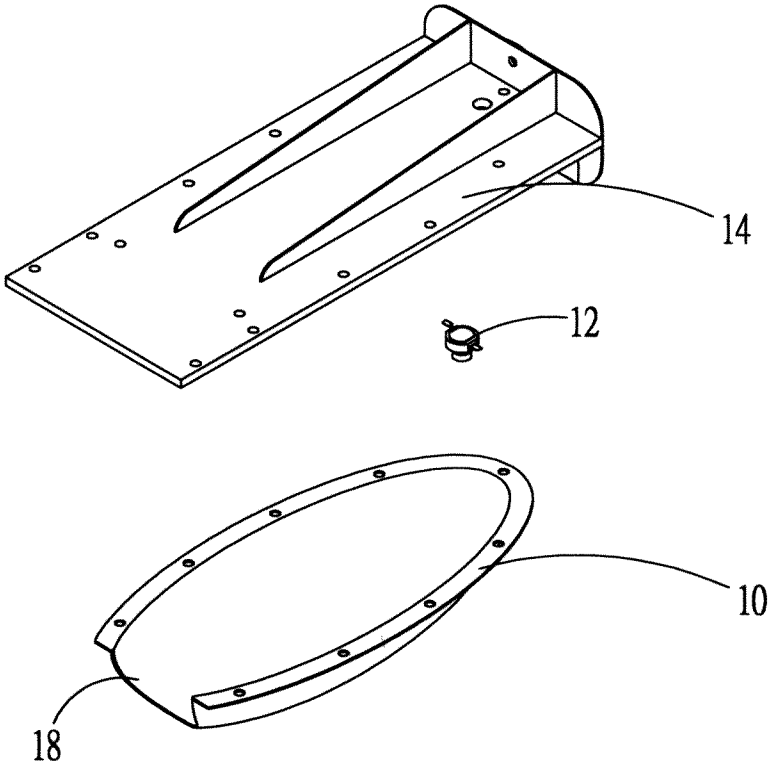
FIG. 2 shows an exploded view of an auto lamp according to a preferred embodiment of the present invention.
Figure 3:
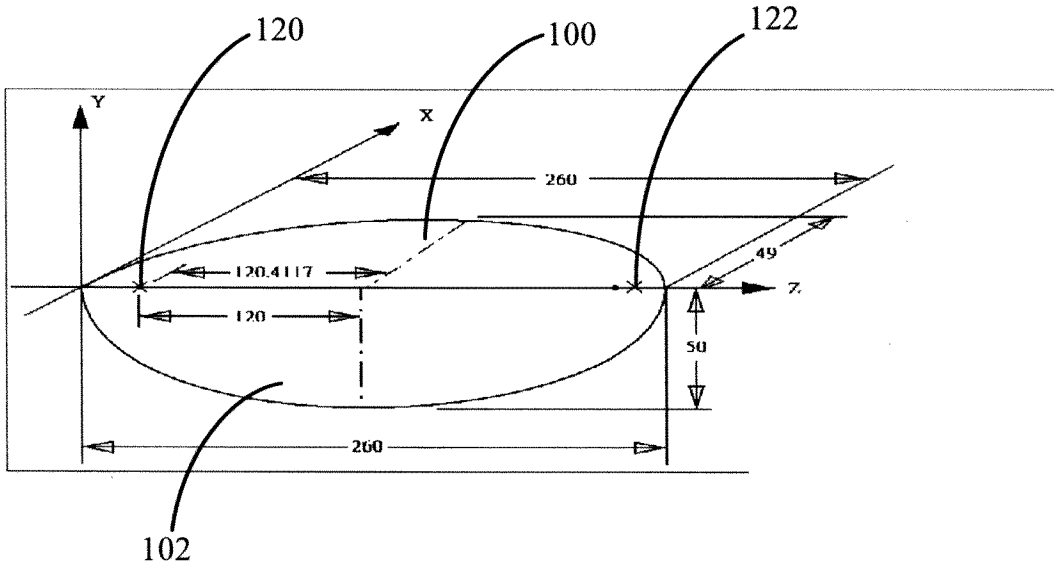
FIG. 3 shows a cross-sectional view of a reflector according to a preferred embodiment of the present invention.

FIG. 1 and FIG. 2 show a schematic diagram and an exploded view of an auto lamp structure according to a preferred embodiment of the present invention. As shown in the figures, the auto lamp structure according to the present invention comprises a first reflector 10, a first light source 12, and a covering part 14. The first reflector 10 exhibits a first ellipse 100 in the direction of a first axis about a center, and exhibits a second ellipse 102 in the direction of a second axis about the center (as shown in FIG. 3). The long axis of the first ellipse 100 is different from the long axis of the second ellipse 102. Alternatively, the short axis of the first ellipse 100 is different from the short axis of the second ellipse 102 (as shown in FIG. 3). Thereby, the first reflector 10 forms a complex ellipse structure. Besides, the first reflector 10 has an opening 18. The first light source 12 is disposed in the first reflector 10, and illuminates light via the opening 18. The covering part 14 is disposed above the first reflector 10 for controlling the distribution pattern of the light. In other words, the covering part 14 covers the upper half of the distribution pattern of the light for complying with the regulations. Because the covering part 14 according to the present invention is a plane and the first reflector 10 is a complex ellipse curved surface, the auto lamp structure according to the present invention is composed by the elliptic reflection surface of the first reflector 10 and the reflection plane of the covering part 14. The complete lighting pattern can be produced without a focusing lens. Even if the distribution pattern of the light produced by the auto lamp structure is a complete lighting pattern, by changing the size of the long or short axis of the elliptic reflection surface of the first reflector 10, the illuminating area of the auto lamp structure can be controlled, and hence producing three illumination structures for the condensed-illumination zone, the tangent-control zone, and the diffusive-illumination zone. The details of the three illumination structures will be described later. The present invention combines the three illumination structures for producing the distribution pattern of the light that can comply with the regulation ECE R112.

FIG. 3 shows a cross-sectional view of a reflector according to a preferred embodiment of the present invention. As shown in the figure, the first light source 12 is disposed at the focal point of the first reflector 10, namely, a first focal point 120 of the elliptic curved surface of the first reflector 10. The first light source 12 is divided into two parts to emit light towards the opening 18 of the first reflector 10. Part of the light of the first light source 12 is emitted through the opening 18 of the first reflector 10; the other part of the light of the first light source 12 is firstly condensed to a second focal point 122 of the first reflector 10 by means of the first reflector 10, and then is emitted through the opening 18. The two parts of light are combined at the illuminated surface. In addition, because the first reflector 10 is disposed under the covering part 14, the light of the first light source 12 is emitted to the ground via the first reflector 10 and the covering part 14. Thereby, owing to the lower position of the first reflector 10, the light emitted at larger angles is reflected to the road by the reflection plane and is thus reused, reducing relatively the power loss of the light and enhancing efficiency.

Figure 4A:
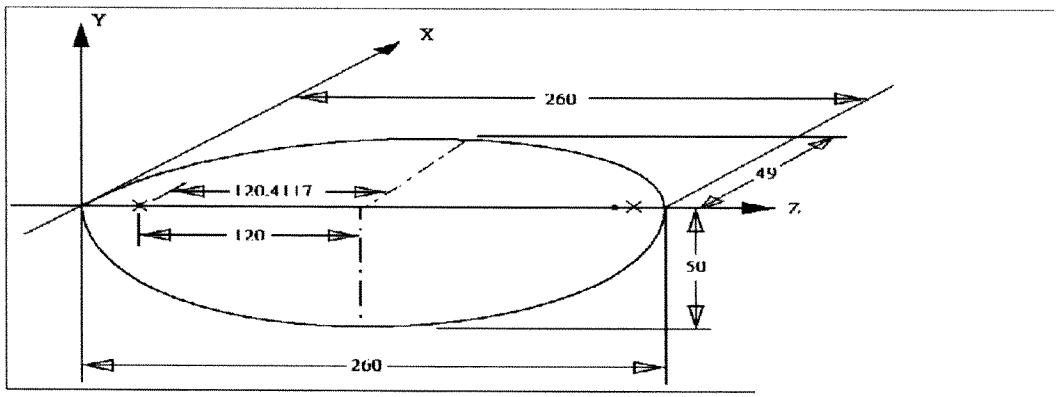
FIG. 4A shows a three-dimensional cross-sectional view of a reflector according to a preferred embodiment of the present invention.
Figure 4B:
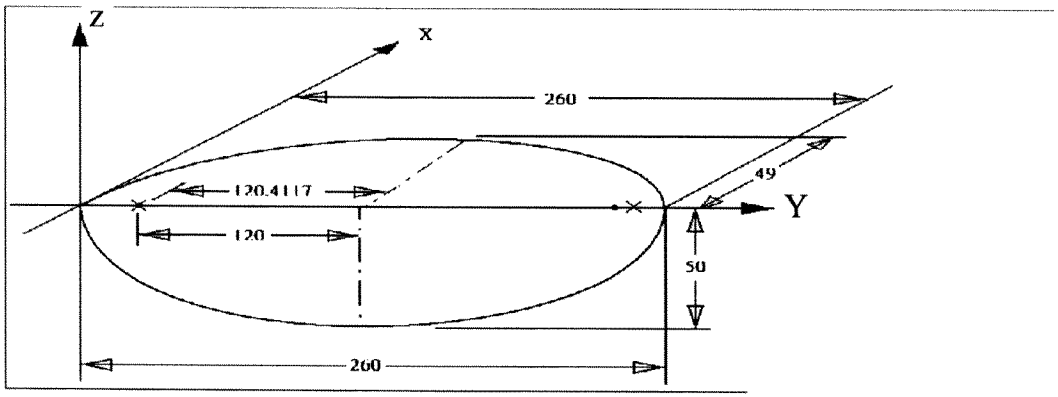
FIG. 4B shows a three-dimensional cross-sectional view of a reflector according to another preferred embodiment of the present invention.
Figure 4C:
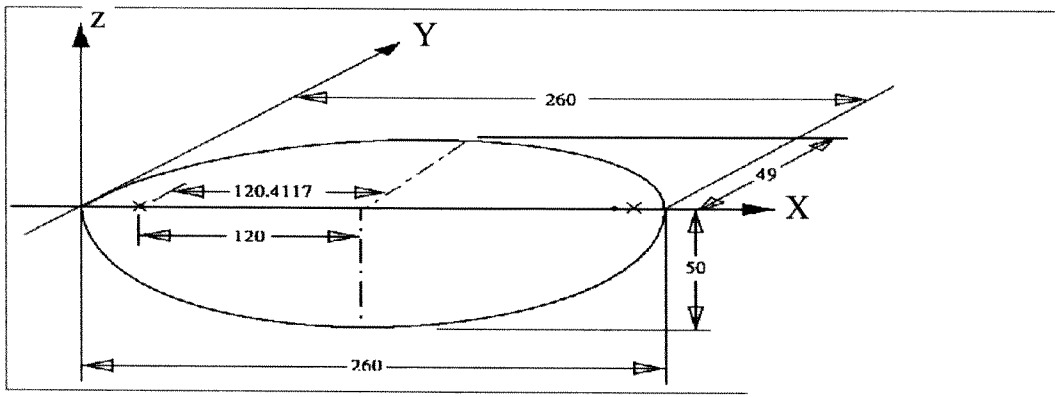
FIG. 4C shows a three-dimensional cross-sectional view of a reflector according to another preferred embodiment of the present invention.

FIGS. 4A to 4C show three-dimensional cross-sectional views of reflectors according to preferred embodiments of the present invention. As shown in FIG. 4A, the direction of the first axis is in the x-axis direction, and the direction of the second axis is in the y-axis direction. As shown in FIG. 4B, the direction of the first axis is in the x-axis direction, and the direction of the second axis is in the z-axis direction. As shown in FIG. 4C, the direction of the first axis is in the y-axis direction, and the direction of the second axis is in the z-axis direction.

Figure 5:
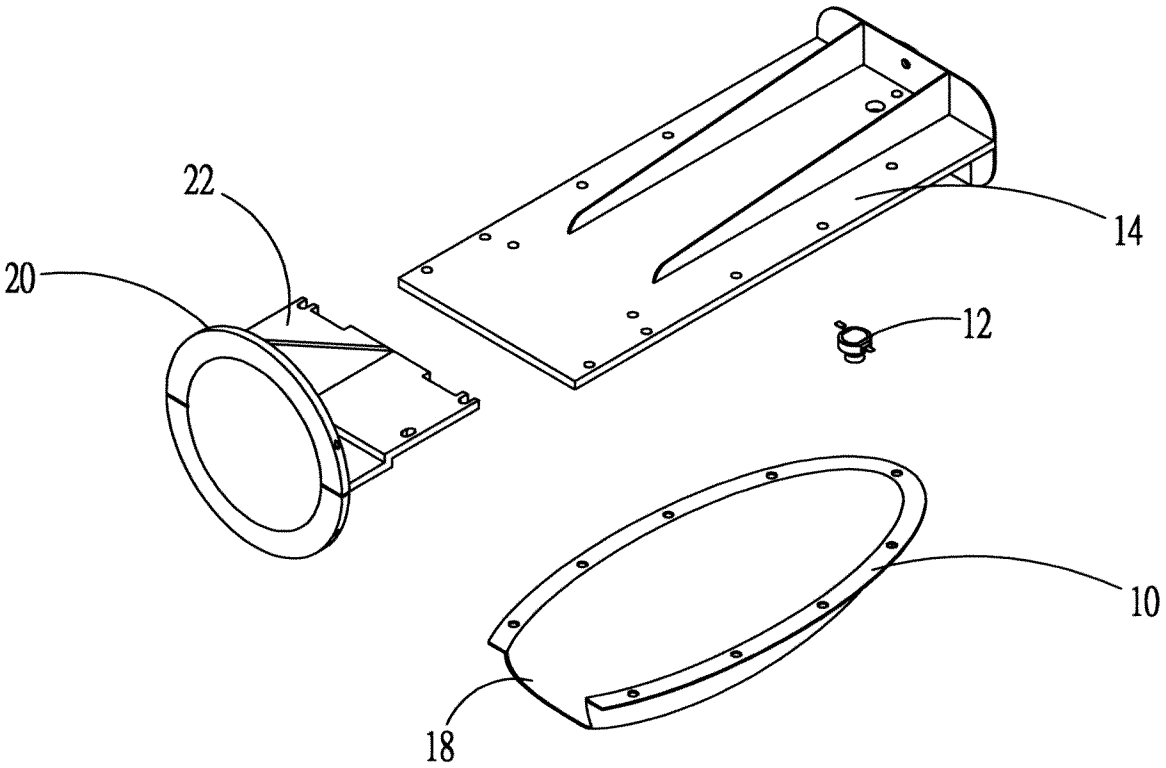
FIG. 5 shows a schematic diagram of an auto lamp structure according to another preferred embodiment of the present invention.

FIG. 5 shows a schematic diagram of an auto lamp structure according to another preferred embodiment of the present invention. As shown in the figure, the difference between the present embodiment and the one in FIG. 1 is that the auto lamp structure according to the present embodiment further comprises an optical lens 20. The optical lens 20 is disposed in front of the opening 18 for controlling the light emitting by the first light source 12 to converge or to diverge. According to the present embodiment, the optical lens 20 is a condensing lens for condensing the emitted light, and hence increasing the illumination intensity of the first light source 12.

In addition, the auto lamp structure according to the present invention further comprises an adjustment structure 22 disposed in the optical lens 20 for adjusting the location of the optical lens 20, and thereby adjusting the focal length of the auto lamp structure. Moreover, the auto lamp structure further comprises a fixing member 24 disposed on the covering part 14 for fixing the auto lamp structure. Besides, the first light source 12 described above is a light-emitting diode (LED).

Figure 6:
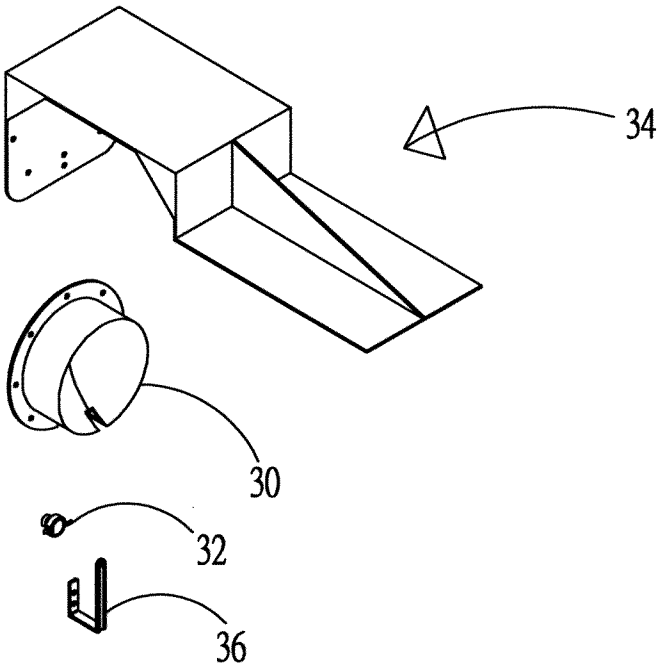
FIG. 6 shows a schematic diagram of an auto lamp structure according to another preferred embodiment of the present invention.
Figure 7:
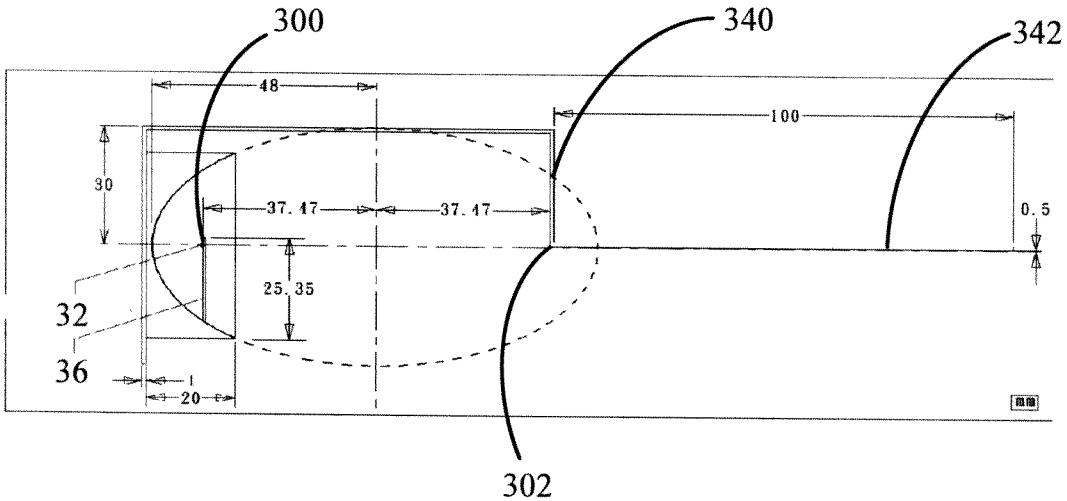
FIG. 7 shows a cross-sectional view of a reflector according to another preferred embodiment of the present invention.

FIG. 6 and FIG. 7 show a schematic diagram and a cross-sectional view of an auto lamp structure according to another preferred embodiment of the present invention. As shown in the figures, the auto lamp structure according to the present embodiment comprises a second reflector 30, a second light source 32, and a light guide 34. The second reflector 30 has an elliptic curved surface. The second light source 32 is disposed in the second reflector 30 for emitting light. The light guide 34 is disposed in front of the second reflector 30 for controlling the distribution pattern of the light. Thereby, the light emitted by the second light source 32 is evened by the light guide 34.

Furthermore, the second light source 32 according to the present embodiment is disposed at a first focal point 300 of the elliptic curved surface of the second reflector 30; and the light guide 34 is disposed at a fourth focal point 302 of the elliptic curved surface of the second reflector 30. Thereby, the auto lamp structure according to the present embodiment covers the upper half of the distribution pattern of the light emitted by the second light source 32 for complying with the regulations. In addition, the light guide 34 can further reflect the upper half of the distribution pattern of the light emitted by the second light source 32 to the ground for increasing the brightness of the auto lamp structure.

The light guide 34 described above includes a covering member 340 and a reflecting member 342. The covering member 340 is disposed in front of the second reflector 30 for covering the upper half of the distribution pattern of the light of the second light source 32. The reflecting member 342 is connected to the covering member 340 for reflecting the light of the second light source 32 and hence increasing the brightness of the auto lamp structure.

Besides, the auto lamp structure according to the present embodiment further comprises a fixing member 36 disposed in the second reflector 30 for fixing the second light source 32. Moreover, the second light source described above 32 is an LED.

Figure 8:
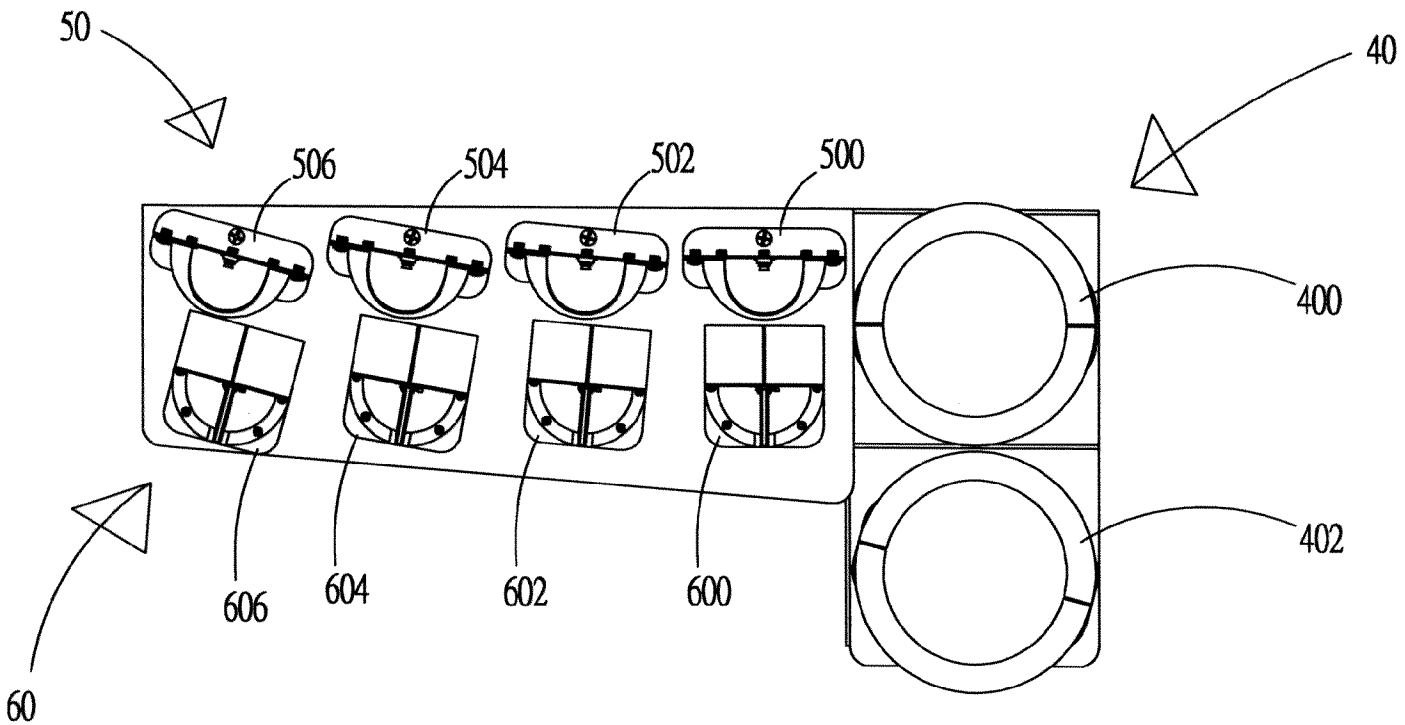
FIG. 8 shows a schematic diagram of an auto lamp structure according to another preferred embodiment of the present invention.

FIG. 8 shows a schematic diagram of an auto lamp structure according to another preferred embodiment of the present invention. As shown in the figure, in addition to complying with the regulations, the auto lamp structure according to the present embodiment further integrates the auto lamp structures described above for enhancing the illumination efficiency of the auto lamp structure. The auto lamp structure according to the present embodiment comprises a condensed-illumination lamp module 40, a tangent-control lamp module 50, and a uniform-illumination lamp module 60. The condensed-illumination lamp module 40 is used for producing first light and hence enhancing the central brightness of a lighting pattern of the auto lamp structure. The tangent-control lamp module 50 is located on one side of the condensed-illumination lamp module 40, and produces second light for controlling the tangent of the lighting pattern of the auto lamp structure. The uniform-illumination lamp module 60 is disposed on one side of the condensed-illumination lamp module 40 and under the tangent-control lamp module for evening the lighting pattern of the auto lamp structure. Condensing lenses are disposed in the components of the condensed-illumination lamp module 40. The whole auto lamp is bar-shaped. The condensed-illumination lamp module 40 is disposed on the side for facilitating the arrangement of the tangent-control lamp module 50 and the uniform-illumination lamp module 60. Because the upper edge of the uniform-illumination lamp module 60 overlaps with the tangent-control lamp module 50, adopting the same arrangement for the two can reduce the risk of affecting the shape of the tangent. Besides, the bar shape coincide with the form of auto lamps perceived by the general public.

The condensed-illumination lamp module 40 includes a first condensed-illumination lamp structure 400 and a second condensed-illumination lamp module 402. The second condensed-illumination lamp module 402 is disposed below the first condensed-illumination lamp module 400. The first condensed-illumination lamp module 400 and the second condensed-illumination lamp module 402 produce the first light for enhancing the central brightness of the lighting pattern. Because the first condensed-illumination lamp module 400 and the second condensed-illumination lamp module 402 are described in the embodiment above, they are not introduced in more details.

In addition, the tangent-control lamp module 50 includes a first tangent-control lamp structure 500, a second tangent-control lamp structure 502, a third tangent-control lamp structure 504, and a fourth tangent-control lamp structure 506. The second tangent-control lamp structure 502 is disposed on one side of the first tangent-control lamp structure 500; the third tangent-control lamp structure 504 is disposed on one side of the second tangent-control lamp structure 502; and the fourth tangent-control lamp structure 506 is disposed on one side of the third tangent-control lamp structure 504. The first tangent-control lamp structure 500, the second tangent-control lamp structure 502, the third tangent-control lamp structure 504, and the fourth tangent-control lamp structure 506 produce the second light for controlling the tangent of the lighting pattern of the auto lamp structure. Because multiple tangent-control lamp structures are used, apparent bended tangents can be produced. Besides, the first tangent-control lamp structure 500 is adjacent to the second tangent-control lamp structure 502 and the angle therebetween is 195 degrees; the second tangent-control lamp structure 502 is adjacent to the third tangent-control lamp structure 504 and the angle therebetween is 175 degrees; and the third tangent-control lamp structure 504 is adjacent to the fourth tangent-control lamp structure 506 and the angle therebetween is 175 degrees. Thereby, in addition to producing apparent bended tangents, the distribution pattern of the light of the light source can avoid producing sharp or contrasting edge regions.

Furthermore, the uniform-illumination lamp module 60 includes a first uniform-illumination lamp structure 600, a second uniform-illumination lamp structure 602, a third uniform-illumination lamp structure 604, and a fourth uniform-illumination lamp structure 606. The second uniform-illumination lamp structure 602 is disposed on one side of the first uniform-illumination lamp structure 600; the third uniform-illumination lamp structure 604 is disposed on one side of the second uniform-illumination lamp structure 602; and the fourth uniform-illumination lamp structure 606 is disposed on one side of the third uniform-illumination lamp structure 604. The a first uniform-illumination lamp structure 600, the second uniform-illumination lamp structure 602, the third uniform-illumination lamp structure 604, and the fourth uniform-illumination lamp structure 606 produce third light for evening the lighting pattern of the auto lamp structure. Thereby, the uniform-illumination lamp module 60 can reinforce the lighting distribution, namely, the bottom left and bottom right of the lighting pattern.

Moreover, because the condensed-illumination lamp structure in the condensed-illumination lamp module 40 is the same as the embodiment in FIG. 5, the tangent-control lamp structure in the tangent-control lamp module 50 is the same as the embodiment in FIG. 1, and the uniform-illumination lamp structure in the uniform-illumination lamp module 60 is the same as the embodiment in FIG. 6, they are not described in more details.

To sum up, the reflector of the auto lamp structure according to the present invention exhibits a first ellipse in the direction of a first axis about a center, and exhibits a second ellipse in the direction of a second axis about the center. The long axis or the short axis of the first ellipse is different from the long axis or the short axis of the second ellipse. In addition, the reflector has an opening. The light source of the auto lamp structure according to the present invention is disposed in the reflector, and illuminates light via the opening. The covering part of the auto lamp structure according to the present invention is disposed above the reflector for controlling the distribution pattern of the light. Thereby, the present invention uses a reflector of a complex ellipse structure to control the distribution pattern of the light of the light source for complying with the regulations.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. An auto lamp structure, comprising:

a condensed-illumination lamp module, producing first light for enhancing the central brightness of a lighting pattern of said auto lamp structure;

a tangent-line control lamp module, located on one side of said condensed-illumination lamp module, and producing second light for controlling the tangent-line of said lighting pattern of said auto lamp structure; and a uniform-illumination lamp module, located on one side of said condensed-illumination lamp module and under said tangent-line control lamp module for evening said lighting pattern of said auto lamp structure;

wherein said tangent-line control lamp module comprises:

a first tangent-line control lamp structure;

a second tangent-line control lamp structure, disposed on one side of said first tangent-line control lamp structure;

a third tangent-line control lamp structure, disposed on one side of said second tangent-line control lamp structure; and a fourth tangent-line control lamp structure, disposed on one side of said third tangent-line control lamp structure;

wherein said first tangent-line control lamp structure, said second tangent-line control lamp structure, said third tangent-line control lamp structure, and said fourth tangent-line control lamp structure produce said second light for controlling the tangent-line of said lighting pattern of said auto lamp structure; said first tangent-line control lamp structure is adjacent to said second tangent-line control lamp structure and the angle therebetween is 195 degrees; said second tangent-line control lamp structure is adjacent to said third tangent-line control lamp structure and the angle therebetween is 175 degrees; and said third tangent-line control lamp structure is adjacent to said fourth tangent-line control lamp structure and the angle therebetween is 175 degrees.

2. The auto lamp structure of claim 1, wherein said condensed-illumination lamp module comprises:

a first condensed-illumination lamp structure;

a second condensed-illumination lamp structure disposed below said first condensed-illumination lamp structure; wherein said first condensed-illumination lamp structure and said second condensed-illumination lamp structure produce said first light for enhancing the central brightness of said lighting pattern;

wherein said first condensed-illumination lamp structure or said second condensed-illumination lamp structure comprises:

a reflector, exhibiting a first ellipse in the direction of a first axis about a center, exhibiting a second ellipse in the direction of a second axis about said center, the long axis or the short axis of said first ellipse being different from the long axis or the short axis of said second ellipse, and having an opening;

a light source, disposed in said reflector, and emitting light through said opening;

a covering part, disposed above said reflector for controlling the distribution pattern of said light, said covering part covers the upper half of the distribution pattern of said light;

an optical lens, disposed in front of said opening of said reflector;

an adjustment structure, disposed in said optical lens for adjusting the location of said optical structure; and a fixing member disposed on said covering part for fixing said auto lamp structure;

wherein said light source is disposed at a focal point of said reflector;

wherein said reflector is disposed under said covering part so that said light is illuminated to the ground via said reflector and said covering part.

3. The auto lamp structure of claim 1, wherein said first tangent-line control lamp structure, said second tangent-line control lamp structure, said third tangent-line control lamp structure, or said fourth tangent-line control lamp structure comprises:

a reflector, exhibiting a first ellipse in the direction of a first axis about a center, exhibiting a second ellipse in the direction of a second axis about said center, the long axis or the short axis of said first ellipse being different from the long axis or the short axis of said second ellipse, and having an opening;

a light source, disposed in said reflector, and emitting light through said opening; and a covering part, disposed above said reflector for controlling the distribution pattern of said light;

wherein said light source is disposed at a focal point of said reflector;

wherein said covering part covers the upper half of the distribution pattern of said light;

wherein said reflector is disposed under said covering part so that said light is illuminated to the ground via said reflector and said covering part.

4. The auto lamp structure of claim 1, wherein said uniform-illumination lamp module comprises:

a first uniform-illumination lamp structure;

a second uniform-illumination lamp structure, disposed on one side of said first uniform-illumination lamp structure;

a third uniform-illumination lamp structure, disposed on one side of said second uniform-illumination lamp structure; and a fourth uniform-illumination lamp structure, disposed on one side of said third uniform-illumination lamp structure;

wherein said first uniform-illumination lamp structure, said second uniform-illumination lamp structure, said third uniform-illumination lamp structure, and said fourth uniform-illumination lamp structure produce third light for evening said lighting pattern of said auto lamp structure;

wherein said first uniform-illumination lamp structure, said second uniform-illumination lamp structure, said third uniform-illumination lamp structure, or said fourth uniform-illumination lamp structure comprises:

a reflector, having an elliptic curved surface;

a light source, disposed in said reflector for emitting light; and a light guide, disposed in front of said reflector for controlling the distribution of said light;

wherein said light source is disposed at a first focal point of said elliptic curved surface; and said light guide is disposed at a second focal point of said elliptic curved surface;

wherein said light guide comprise:

a covering member, disposed in front of said reflector for covering the upper half of the distribution pattern of said light;

a reflecting member, connecting to said covering member for reflecting said light of said light source; and a fixing member disposed in said reflector for fixing said auto lamp structure.

* * * * *